US006300609B1

(12) United States Patent
Kim

(10) Patent No.: US 6,300,609 B1
(45) Date of Patent: Oct. 9, 2001

(54) DOOR TO MICROWAVE OVEN, CONTROL PANEL AND CABLE ASSEMBLY

(75) Inventor: Su Hwan Kim, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/641,724

(22) Filed: Aug. 21, 2000

(30) Foreign Application Priority Data

Aug. 21, 1999 (KR) ..... 99-34836
Sep. 6, 1999 (KR) ..... 99-37723

(51) Int. Cl.[7] ..... H05B 6/68
(52) U.S. Cl. ..... 219/702; 219/720; 219/739; 219/506; 126/200
(58) Field of Search ..... 219/739, 720, 219/702, 506; 126/190, 200

(56) References Cited

U.S. PATENT DOCUMENTS 4,255,640 3/1981 Bressler ..... 219/739

FOREIGN PATENT DOCUMENTS 38 29 913 * 3/1990 (DE) .
59-60128 * 4/1984 (JP) .
60-42516 * 3/1985 (JP) .
9-14673 * 1/1997 (JP) .

* cited by examiner

*Primary Examiner*—Philip H. Leung

(57) ABSTRACT

Door to a microwave oven including a door panel which forms a frame of the door, a front panel fitted to a front face of the door panel, a door frame fitted to rear face of the door panel, and a control part fitted between the front panel and the door frame for receiving a work order from a user, controlling an electric component, and indicating various information, thereby permitting handling of the door and servicing to the control part easy, and preventing damage to the first cable.

5 Claims, 10 Drawing Sheets

DOOR TO MICROWAVE OVEN, CONTROL PANEL AND CABLE ASSEMBLY

BACKGROUND OF THE INVENTION

1. Field of the Invention

The present invention relates to a door to a microwave oven, and more particularly, to a door to a microwave oven, having a controller integrated thereto.

2. Background of the Related Art

In general, in a frontal surface of the microwave oven, there are an output part for indicating various information thereon and an input part for a user to provide a required cooking time period and the like to the microwave oven, both of which are electrically connected to a circuit board. That is, the circuit board is provided with a work order from the user through the input part, to control various electric components, such as a magnetron, and present various information to the output part. In the meantime, of the microwave oven, one mounted over a heating apparatus, such as a gas range, is so called a wall mounting type microwave oven, which is required to discharge a cooking heat and a heat generated at the electric components in the microwave oven to outside of the microwave oven, smoothly. A related art wall mounting type microwave oven will be explained, with reference to FIG. 1.

A body 10 of the related art wall mounting type microwave oven is mounted on a wall 1, which has a door 20 in a front face thereof for selectively opening/closing a cooking chamber. There is a vent grill 40 in an upper portion of the door 20 for discharging odor and heat and the like to outside of the microwave oven, and a control part 30 on one side of the door 20. That is, the door 20 and the control part 30 are mounted to the body 10, separately. As shown in FIG. 2, the door is provided with a door panel 21 forming an overall frame ol the door, a front panel 22 of transparent glass fitted to a front face of the door panel 21, and a door frame 23 spaced a distance from the front panel 22 to form a rear face of the door.

The control part will be explained with reference to FIG. 3. The control part 30 is provided with a key pad 31, a control panel 32, a bracket 33, and a circuit board 34 assembled in an order starting from the front face of the body 1 to the rear face thereof. The circuit board 34 is electrically connected to electric components, such as the magnetron(not shown). The key pad 31 has a plurality of selection buttons 31*a* for a user to select cooking power, cooking time period, and the like, connected to the circuit board, electrically. There is an ICD 34*a* integrated to the circuit board 34 for displaying various information, and passed through the bracket 33, control panel 32, and the key pad 31, such that the LCD 34*a* is exposed to outside of the microwave oven for the user to notice the various information displayed thereon.

As shown in FIG. 4, in the foregoing related art wall mounting type microwave oven, the LCD in the output part, and the key pad in the input part are positioned above a height of eyes of the user, to require the user's eyes to look upward and the user's hand to direct upward in handling the key pad, that are not convenient for the user. This problem is caused by the mounting of the control part on one side of the door, limiting a mounting position of the control part.

The problem becomes more serious when the microwave oven is of a type to be mounted above a user's height, such as the wall mounting type microwave oven. And, it is required to solve this problem taking the fact that use of the wall mounting type microwave oven is increased gradually into account. As one of methods for solving the problem, U.S. Pat. No. 4,255,640 discloses a microwave oven, wherein the control part is mounted, not on the body of the microwave oven, but on the door. However, the U.S. Pat. No. 4,255,640 fails to solve the problem because the control part is mounted to an upper portion of the door that requires the user's eyes and hand to direct upward.

And, the U.S. Pat. No. 4,255,640 requires the control part on the door to connect an electrical component with one cable. Therefore, the cable should be comparatively long, which is not convenient for transportation of the door for assembly to the body, and has a possibility of damage during the transportation. Moreover, it is difficult of disassemble the door only from the body once the door assembly to the body is completed. Accordingly, disassembly of the door only is difficult in a case of trouble of the control part and the like, and the microwave oven itself should be dismounted from the wall, and an outer case of the microwave oven should be removed, for disassembly of the door.

SUMMARY OF THE INVENTION

Accordingly, the present invention is directed to a door to a microwave oven that substantially obviates one or more of the problems due to limitations and disadvantages of the related art.

An object of the present invention is to provide a door to a microwave oven, which can improve convenience of use.

Other object of the present invention is to provide a door to a microwave oven, which can improve assembly work and servicing work.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the door to a microwave oven includes a door panel which forms a frame of the door, a front panel fitted to a front face of the door panel, a door frame fitted to rear face of the door panel, and a control part fitted between the front panel and the door frame for receiving a work order from a user, controlling an electric component, and indicating various information.

The control part includes a circuit board, a conduction switch fitted between the circuit board and the front panel for sensing a user's work order and transmitting the work order to the circuit board, and an LCD electrically connected to the circuit board for indicating various information.

The control part and the electric component are connected with a first cable connected to the control part and a second cable connected to the electric component.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
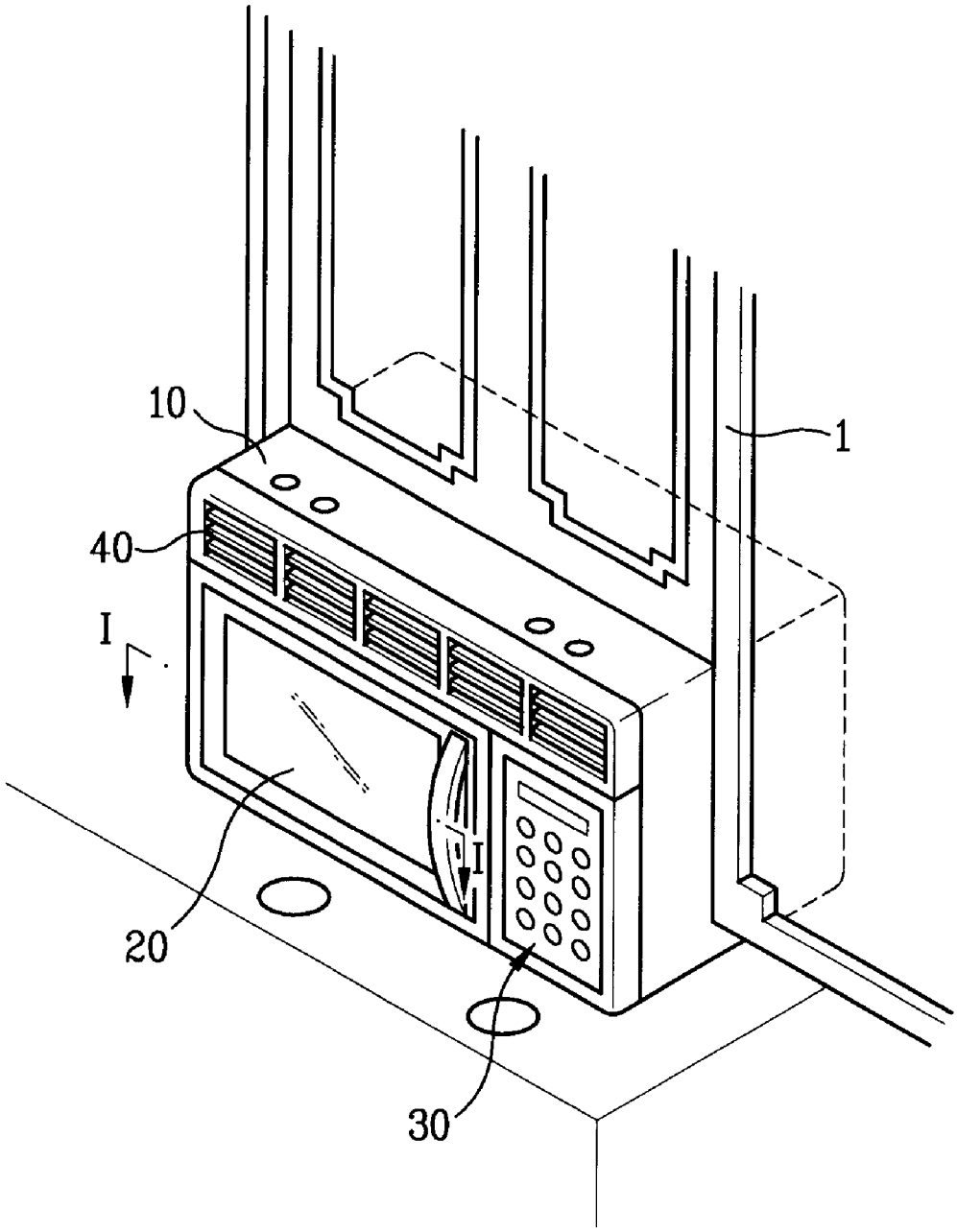
FIG. 1 Related Art
FIG. 1 illustrates a perspective view showing a mounted state of a related art wall mounting type microwave oven.
Figure 2:
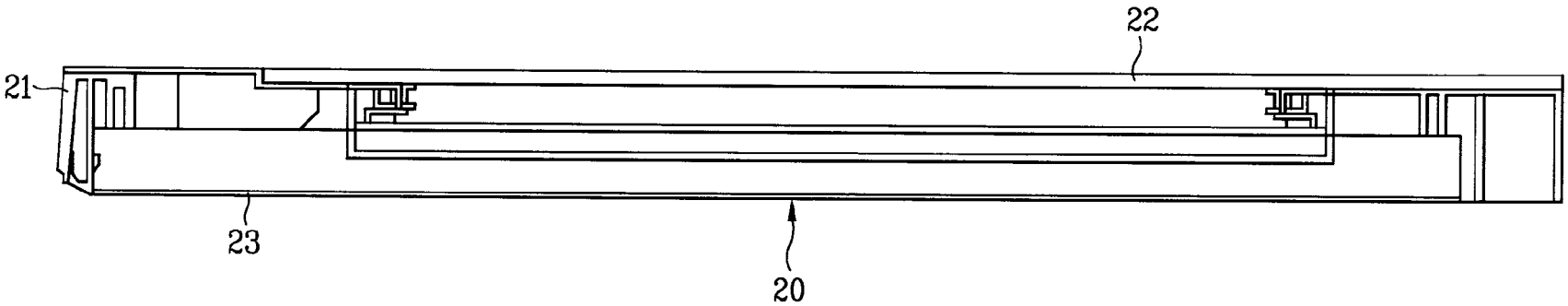
FIG. 2 Related Art
FIG. 2 illustrates a section across line I—I in FIG. 1.
Figure 3:
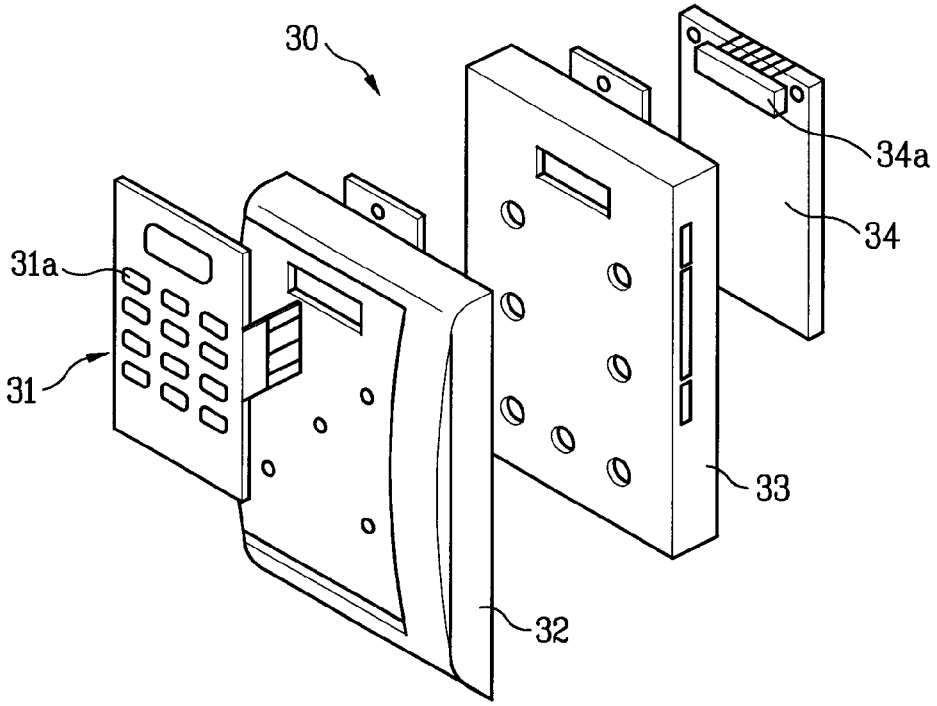
FIG. 3 Related Art
FIG. 3 illustrates a disassembled perspective view showing the control part in FIG. 1.
Figure 4:
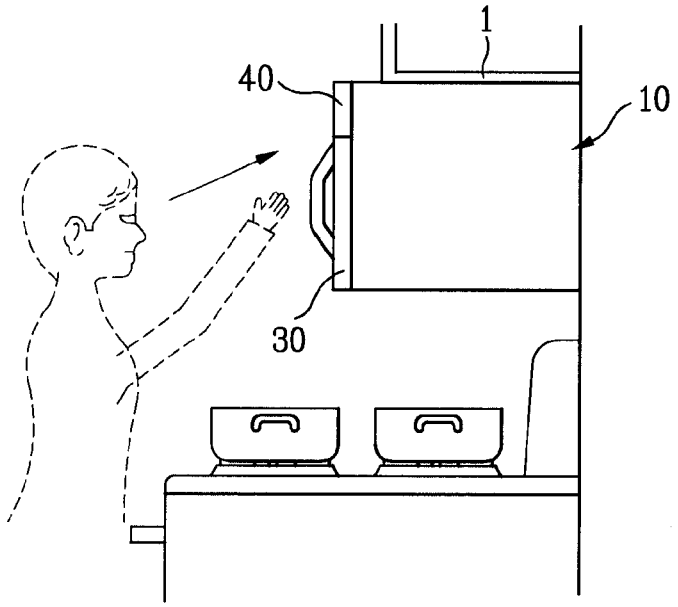
FIG. 4 Related Art
FIG. 4 illustrates a related art wall mounting type microwave oven in use.
Figure 5:
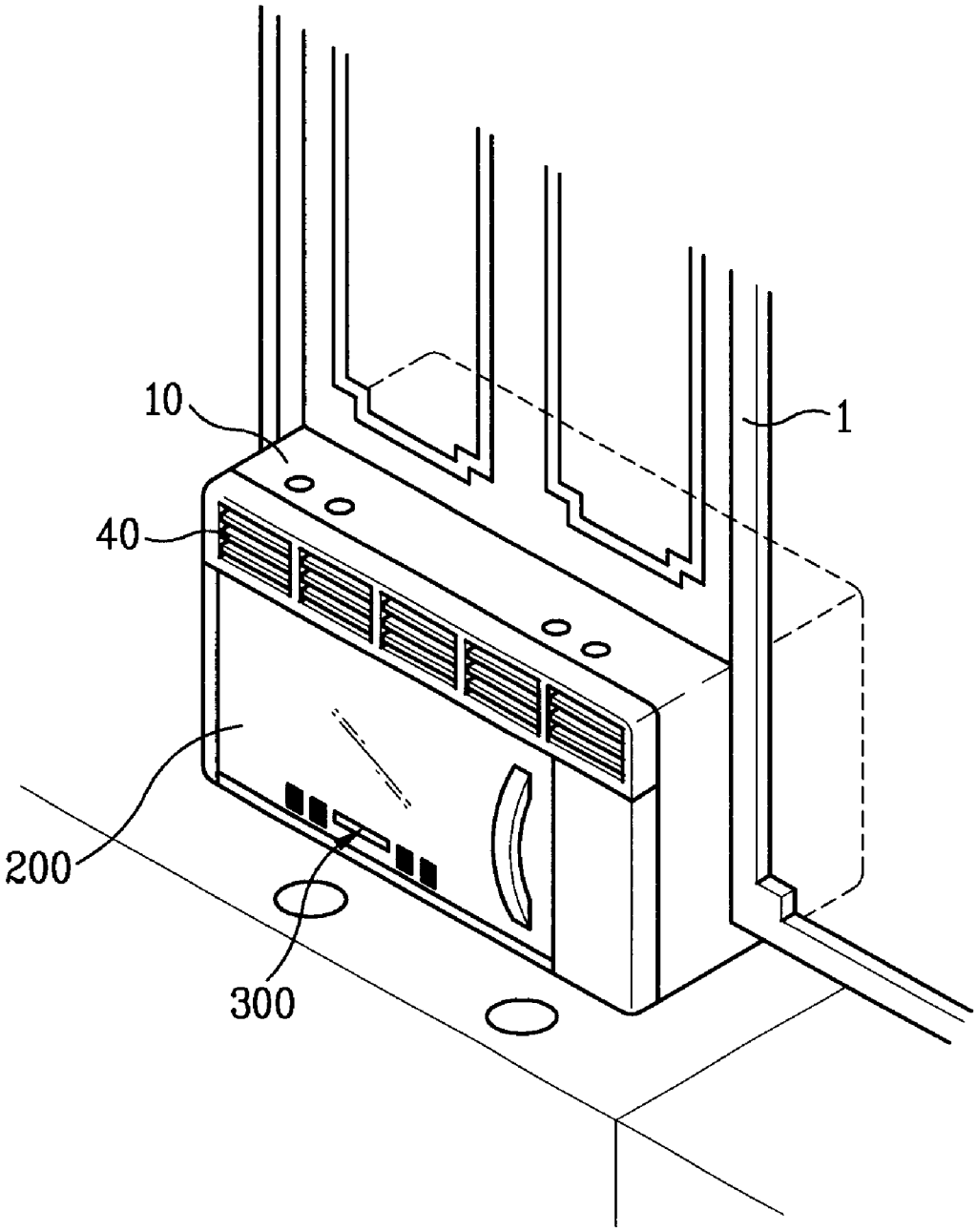
FIG. 5 illustrates a perspective view showing a mounted state of a wall mounting type microwave oven of the present invention.
Figure 6:
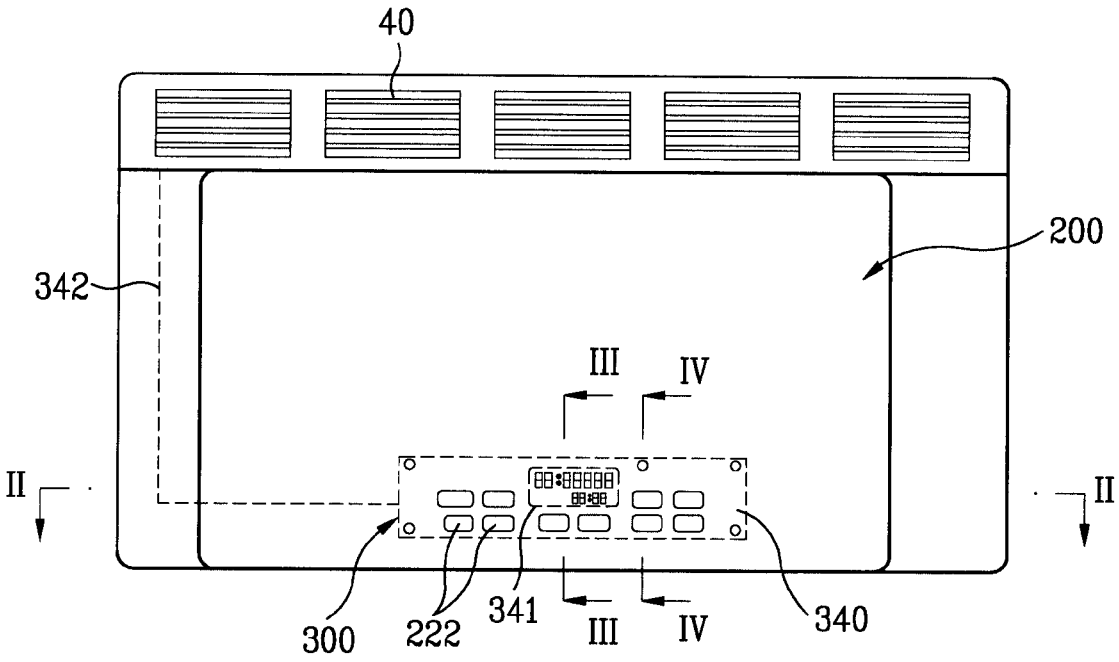
FIG. 6 illustrates a front view of a wall mounting type microwave oven in accordance with one preferred embodiment of the present invention.
Figure 7:
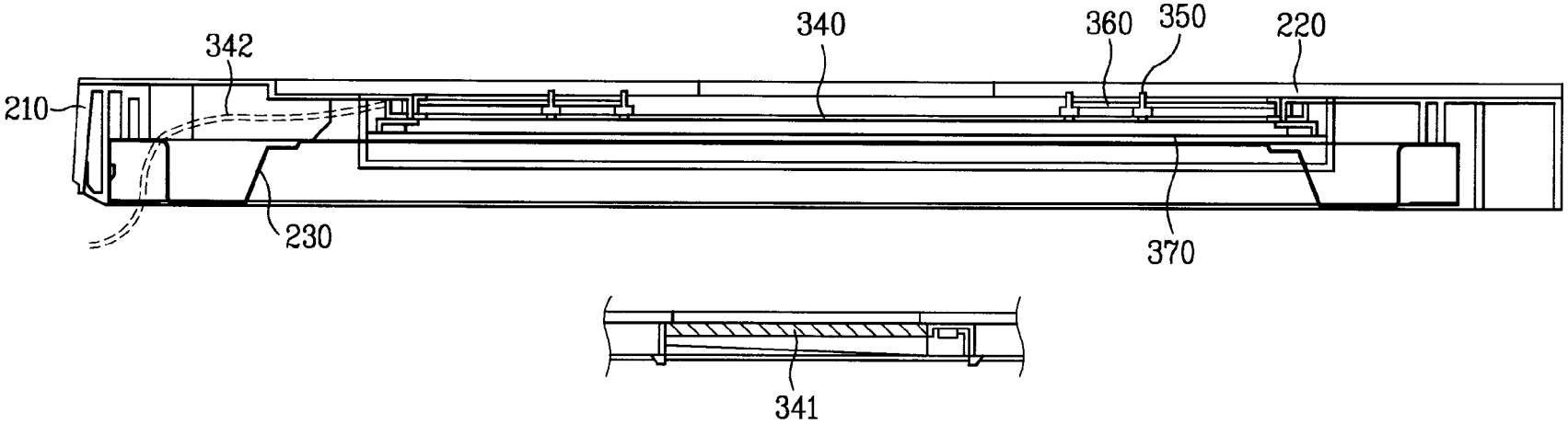
FIG. 7 illustrates a section across line II—II in FIG. 6.
Figure 8:
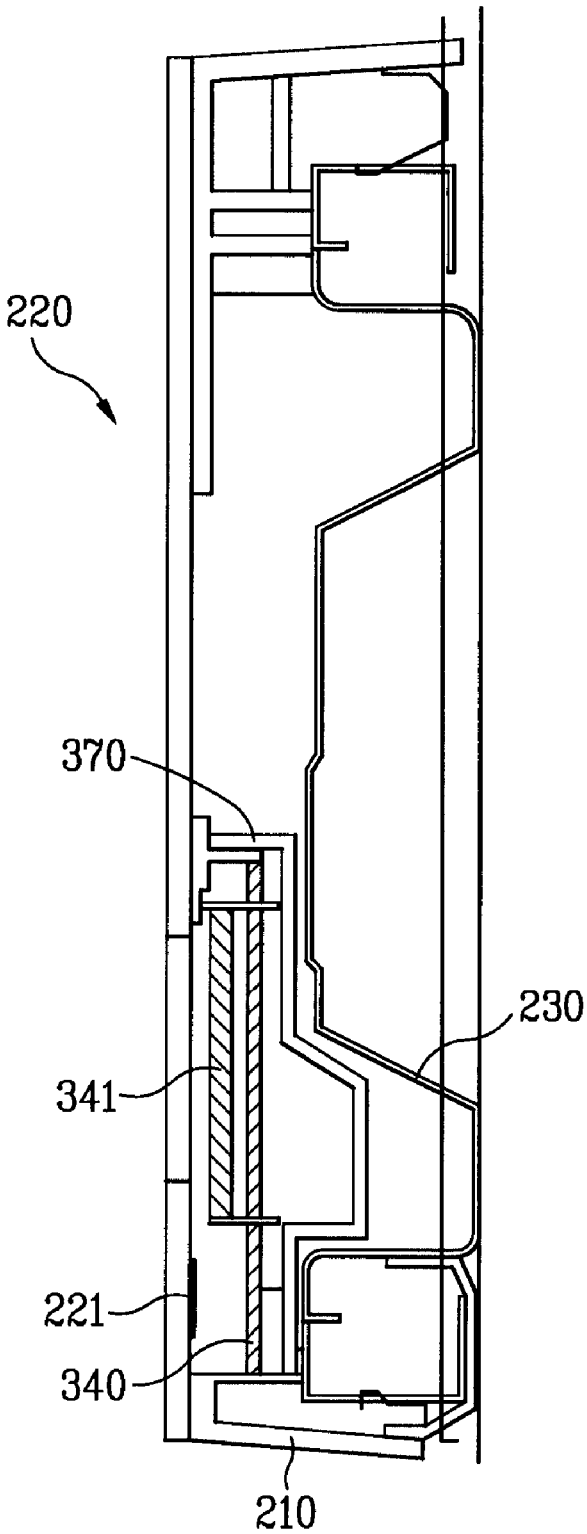
FIG. 8 illustrates a section across line III—III in FIG. 6.

Reference will now be made in detail to the preferred embodiments of the present invention, examples of which are illustrated in the accompanying drawings. As shown in FIG. 5, the present invention suggests to mount a control part 300 on a lower portion of a door 200 for improving convenience of use. A door structure having the control part integrated thereto will be explained, with reference to FIGS. 6 to 8.

Figure 9:
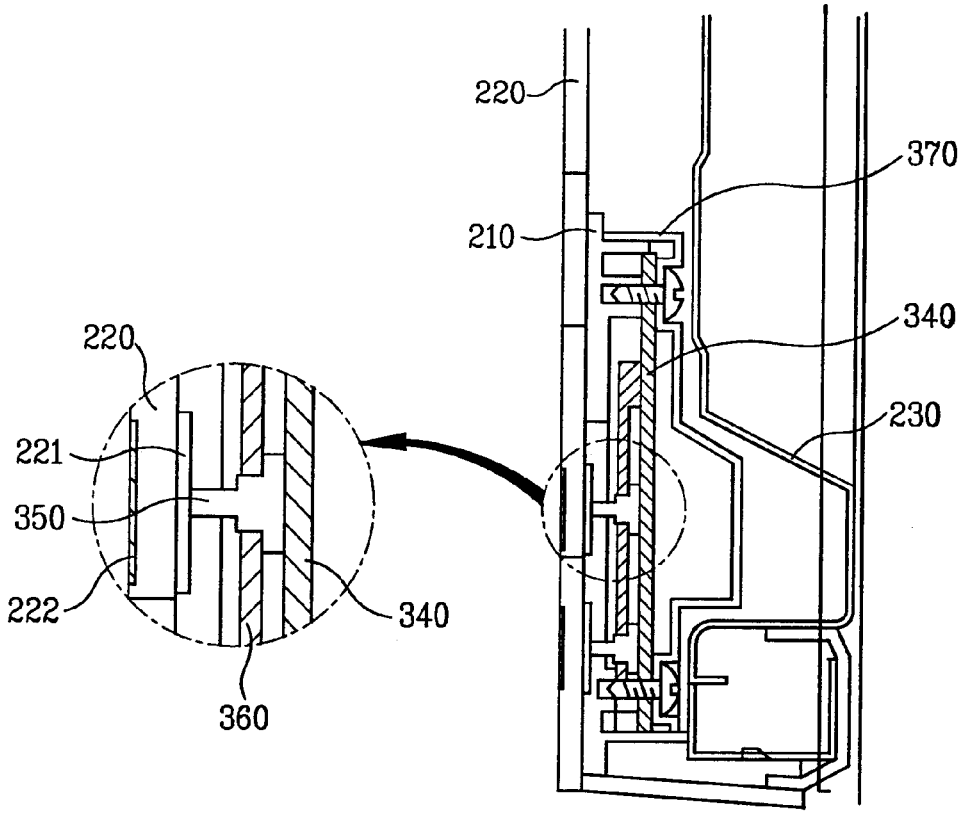
FIG. 9 illustrates a section across line IV—IV in FIG. 6.

The control part 300 is mounted in a space between a front panel 220 and a door frame 230, and the control part 300 and electric components are electrically connected with cables 342 led through an opening(not shown) in an upper portion of one side of the door 200 and an opening(not shown) in the body. There is a circuit board 340 having various circuit components fitted thereon mounted to the door panel 210, and a conduction switch 350, an input part, between the circuit board 340 and the front panel 220. And, it is preferable that there is a switch pad 360 for fastening the conduction switch 350 thereto for preventing the conduction switch 350 from being out of position. There is an LCD 341, an output part, connected to the circuit board 340 and exposed to outside of the microwave oven for notice of the user. It is preferable that there is a shield cover 370 to cover the circuit board 340. Because, though the infiltration of moist generated during cooking can be blocked to some extent by means of the door frame 230, it is preferable that the shield cover 370 is provided, not only for more effective blocking of the moist infiltration, but also for preventing damage to the circuit components caused by impact, and the like. And, in the present invention, membrane switches or tactile switches used generally as the input part for the user to provide a required cooking time period, and the like in the related art are not employed, but conduction switches, i.e., a type of switch in which a weak current generated at skin of a person is utilized are employed, which will be explained in detail, with reference to FIG. 9.

Though the front panel 220 may be formed of any material as far as the material is conductive at a physical contact with a person, it is preferable that the front panel 220 is formed of glass for visual access to a cooking chamber. And, there is a function indicating part 222 on a front face(where the conduction switches are provided) of the front panel 220 for indicating functions of respective conduction switches, for example, a cooking time period, a cooking power, and the like, and conduction switches 350 between a back of the function indicating part 222 and the circuit board 340. The conduction switch 350 is formed of a conductive elastic rubber so that the circuit board 340 is brought into close contact with the front panel 220. It is preferable that a length of the conduction switch 350 is greater than a distance between the circuit board 340 and the front panel 220. It is preferable that a layer of conductive ceramic coating 221 is applied to a region of the front panel 220 one end of the conduction switch is brought into contact therewith, because this permits to provide a larger user contact sensing area, such as the function indicating part 222. The larger area of the function indicating part 222 permits easier description of functions of the conduction switches to be written on the function indicating part 222, for example, characters for explaining various functions, such as the cooking time period, the cooking power, quantity of food to be cooked, and the like, and easier sensing of the user's contact. In the foregoing system, a user's work order can be transmitted to the circuit board 340 through the conduction switch 350 once the user makes contact to the function indicating part 222 by a finger. Of course, the circuit board 340 is provided with means for converting a weak current transmitted through the conduction switch 350 into a voltage, and means for identifying a conduction switch the user makes contact thereto.

Though the foregoing embodiment door to a microwave oven of the present invention shows and describes a door to a wall mounting type microwave oven, the present invention is not limited thereto, but applicable to a general microwave oven.

Figure 10:
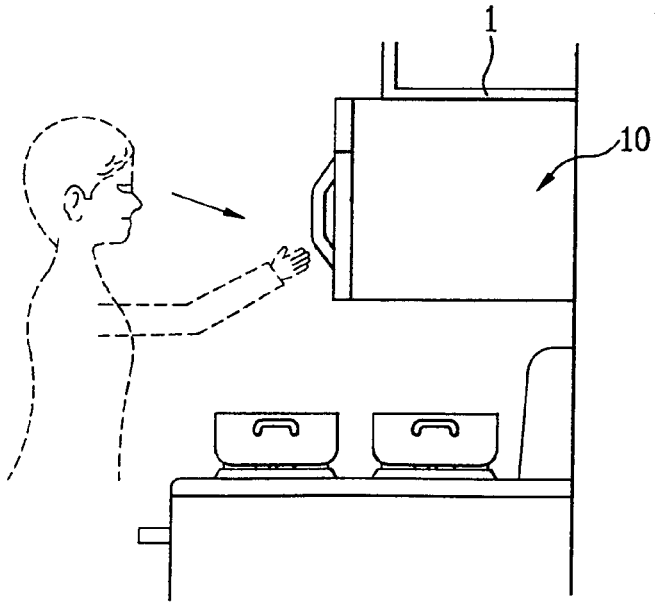
FIG. 10 illustrates a wall mounting type microwave oven of the present invention in use.

Referring to FIG. 10, the foregoing embodiment door to a microwave oven of the present invention permits to place the control part lower than user's eyes, such that the user can see various information and handle the control part with easy, thereby improving convenience of use and reliability of the microwave oven, and providing a greater freedom for changing a design of an outer appearance of the microwave oven to improve a value of the microwave oven.

Figure 11:
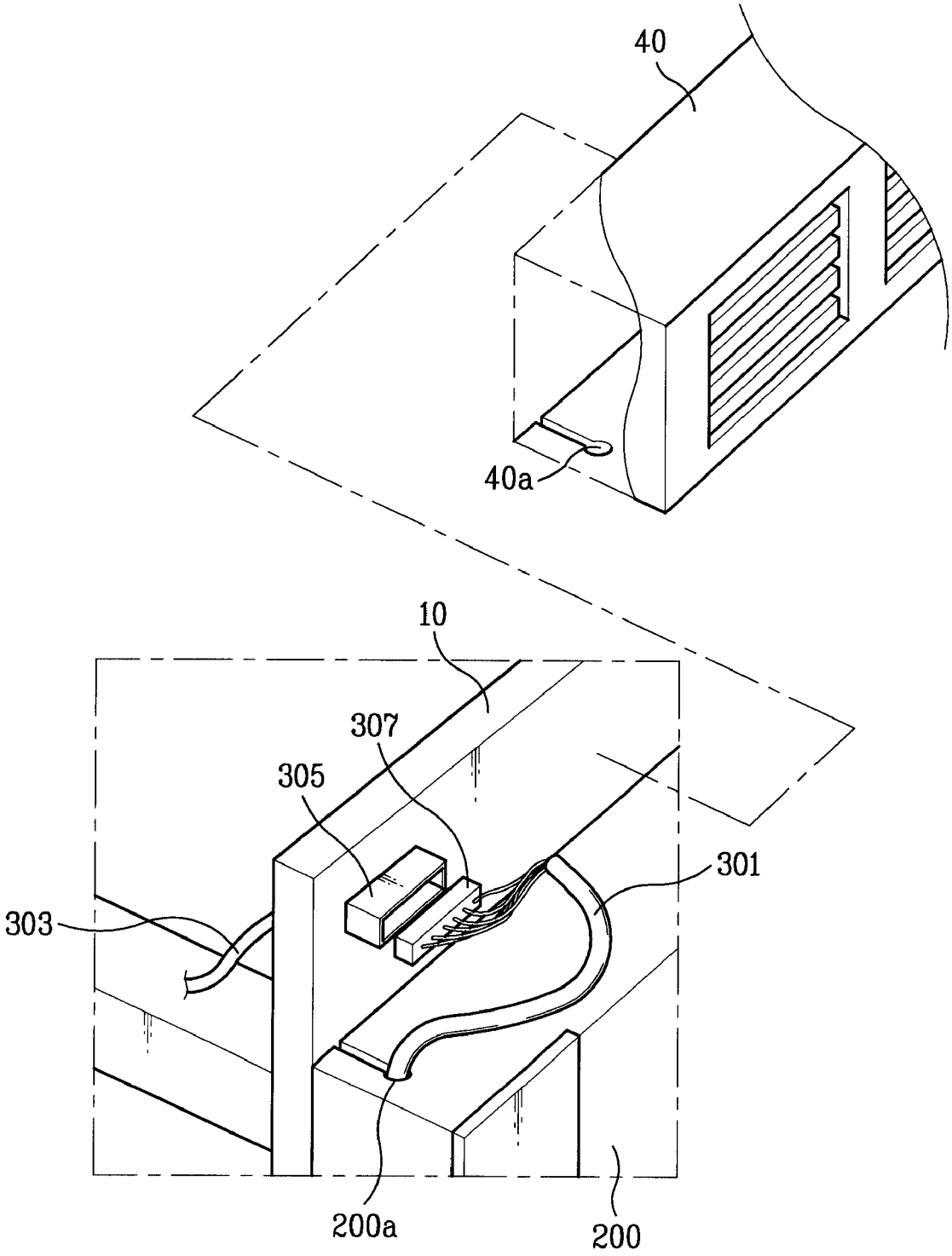
FIG. 11 illustrates a perspective view of a wall mounting type microwave oven in accordance with other preferred embodiment of the present invention; and, FIG. 12 illustrates a perspective view of a wall mounting type microwave oven in accordance with another preferred embodiment of the present invention.

Other embodiment of the present invention will be explained with reference to FIG. 11.

The foregoing embodiment door to a microwave oven has the control part on the door connected to an electric part with one cable. However, as explained in the related art, such a case is not favorable for assembly and disassembly of the door. Therefore, it is preferable that a cable 301 (hereafter called as "a first cable") connected to the control part and a cable 303(hereafter called as "a second cable") connected to the electric component, and a cable holder 307 or 305 is provided to an end of each of the first cable 301 and the second cable 303, for connection/disconnection of the cables as required. In detail, there is a first holder 307 at an end of the first cable 301, and a second holder 305 at an end of the second cable 303 detachable from the first holder 307. The first cable 301 is led through a top of one side of the door

200, and the second cable 303 is led through a top of left side of the front face of the body via an air duct (not shown). That is, there is a lead opening 200*a* in a top portion of the door 200 for leading the first cable therethrough, and a lead opening 40*a* in a vent grill 40 corresponding to the lead opening 200*a*. And, it is preferable that the lead openings 200*a* and 40*a* are formed at positions substantially falling on an axis of rotation of the door 200 in closing/opening the door 200. Thus, as connection/disconnection of the first and second holders 307 and 306 only is required in assembly/disassembly of the door 200 to/from the body 10, the assembly/disassembly of the door 200 to/from the body 10 becomes very simple.

Since the foregoing embodiment door to a microwave oven of the present invention can shorten a length of the first cable 301 to the door 200, handling of the door 200 is easy and damage to the first cable can be prevented. And, when the control part on the door 200 is in trouble, since disassembly of the door 200 only is possible, service to the control part is very easy.

Figure 12:
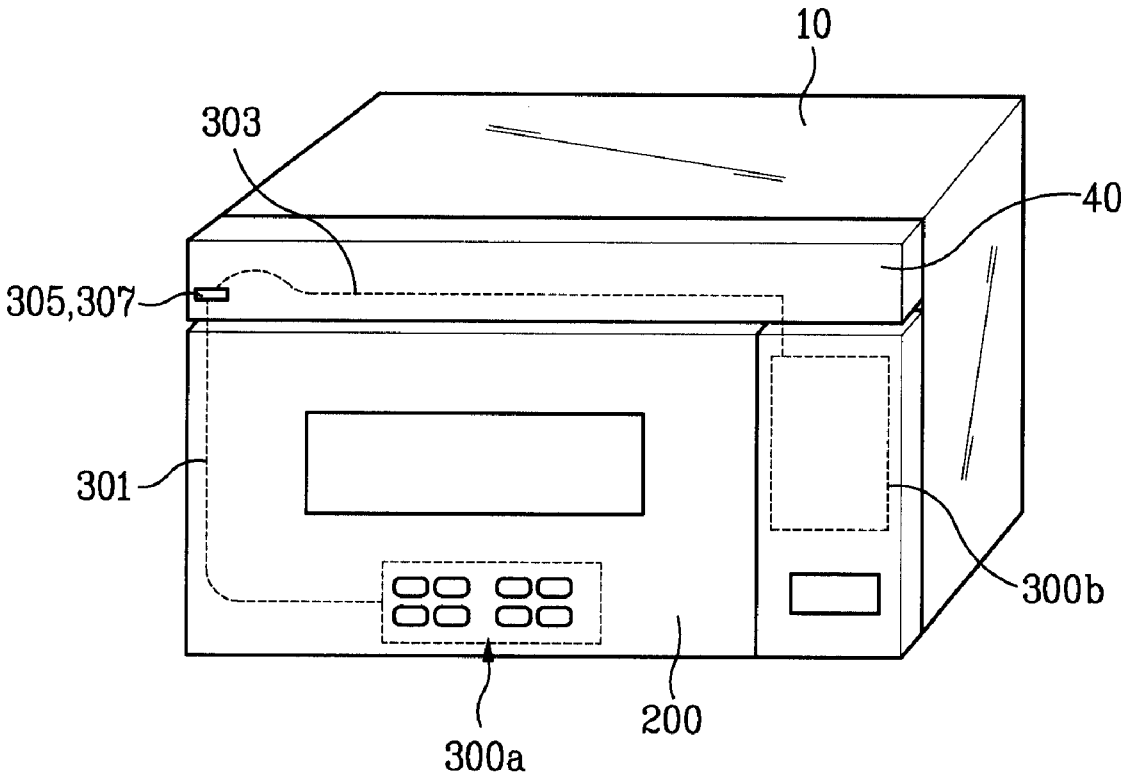

In the meantime, the foregoing embodiment door to a microwave oven of the present invention shows and explains that all the conduction switches., LCD and circuit board are fitted to the door. However, the present invention is not limited thereto, but as shown in FIG. 12, only the input part and the output part 300*a*, such as the conduction switches and the LCD, may only be fitted to the door 200, while the circuit board 300*b* which controls the electric components may be mounted on the body 10 of the microwave oven.

It will be apparent to those skilled in the art that various modifications and variations can be made in the door to a microwave oven of the present invention without departing from the spirit or scope of the invention. Thus, it is intended that the present invention cover the modifications and variations of this invention provided they come within the scope of the appended claims and their equivalents.

What is claimed is:

1. A door to a microwave oven comprising:

a door panel which forms a frame of the door;

a front panel fitted to a front face of the door panel;

a door frame fitted to a rear face of the door panel; and a control part fitted between the front panel and the door frame for receiving a work order from a user, controlling an electric component, and indicating various information, the control part and the electric component being connected with a first cable connected to the control part and a second cable connected to the electric component, the first cable including a first holder at an end thereof, and the second cable including a second holder corresponding to the first holder at an end thereof; said first and second holders being detachably connectable to each other.

2. A door as claimed in claim 1, wherein the control part includes;

a circuit board, a conduction switch fitted between the circuit board and the front panel for sensing a user's work order and transmitting the work order to the circuit board, and an LCD electrically connected to the circuit board for indicating various information, wherein the conduction switch and the LCD are provided in a lower portion of the door.

3. A door as claimed in claim 2, further comprising a layer of conductive material coating applied to a region of the front panel in contact with the conduction switch.

4. A door as claimed in claim 3, further comprising a switch pad for fixing the conduction switch thereto.

5. A door as claimed in claim 4, further comprising a shield cover for protecting the circuit board.

* * * * *